US011066808B2

(12) United States Patent
Takeuchi et al.

(10) Patent No.: US 11,066,808 B2
(45) Date of Patent: Jul. 20, 2021

(54) WORK MACHINE

(71) Applicant: HITACHI CONSTRUCTION MACHINERY CO., LTD., Tokyo (JP)

(72) Inventors: Hiroki Takeuchi, Tsukuba (JP); Kouji Ishikawa, Kasumigaura (JP); Shiho Izumi, Hitachinaka (JP); Shuuichi Meguriya, Ishioka (JP); Tarou Akita, Kasumigaura (JP)

(73) Assignee: HITACHI CONSTRUCTION MACHINERY CO., LTD., Tokyo (JP)

( * ) Notice: Subject to any disclaimer, the term of this patent is extended or adjusted under 35 U.S.C. 154(b) by 222 days.

(21) Appl. No.: 16/320,504

(22) PCT Filed: Oct. 31, 2017

(86) PCT No.: PCT/JP2017/039400
§ 371 (c)(1),
(2) Date: Jan. 25, 2019

(87) PCT Pub. No.: WO2018/092582
PCT Pub. Date: May 24, 2018

(65) Prior Publication Data

US 2020/0024821 A1 Jan. 23, 2020

(30) Foreign Application Priority Data

Nov. 16, 2016 (JP) ..... JP2016-223591

(51) Int. Cl.
*E02F 3/43* (2006.01)
*E02F 9/22* (2006.01)
(Continued)

(52) U.S. Cl.
CPC ..... *E02F 3/43* (2013.01); *E02F 9/2221* (2013.01); *E02F 9/2267* (2013.01);
(Continued)

(58) Field of Classification Search
USPC ..... 701/50
See application file for complete search history.

(56) References Cited

U.S. PATENT DOCUMENTS 5,735,065 A 4/1998 Yamagata et al.
5,968,104 A * 10/1999 Egawa ..... E02F 3/437 701/50

(Continued)

FOREIGN PATENT DOCUMENTS

JP 2000-220601 A 8/2000
JP 3091667 B2 9/2000

OTHER PUBLICATIONS

International Preliminary Report on Patentabiltiy received in corresponding International Application No. PCT/JP2017/039400 dated May 31, 2019.

(Continued)

*Primary Examiner* — Tyler D Paige
(74) *Attorney, Agent, or Firm* — Mattingly & Malur, PC

(57) ABSTRACT

A work machine includes: control valves that control flows of a hydraulic operating oil supplied to actuators; operation lever devices that generate hydraulic signals to be output to the corresponding control valves according to an operation; solenoid proportional valves that reduce pressure of the hydraulic signals generated by the corresponding operation lever devices; and a front implement control section that controls the solenoid proportional valves. The work machine further includes: operation signal lines connected to the operation lever devices; signal input lines connected to the control valves; pressure reducing lines provided with the solenoid proportional valves; and selector valves that have a first position that interrupts connection of the operation signal lines and the pressure reducing lines and directly connects the operation signal lines to the signal input lines, (Continued)

and a second position that connects the operation signal lines to the signal input lines via the pressure reducing lines.

6 Claims, 8 Drawing Sheets

(51) Int. Cl.
*F15B 11/046* (2006.01)
*F15B 11/08* (2006.01)
*F15B 21/02* (2006.01)

(52) U.S. Cl.
CPC ..... *E02F 9/2285* (2013.01); *F15B 11/046* (2013.01); *F15B 11/08* (2013.01); *F15B 21/02* (2013.01)

(56) References Cited

U.S. PATENT DOCUMENTS 6,169,948 B1 * 1/2001 Fujishima ..... E02F 3/435 701/50
2006/0083622 A1 * 4/2006 Tatsuno ..... F16H 61/4183 417/44.2
2006/0156714 A1 * 7/2006 Kim ..... E02F 9/2285 60/422
2010/0207633 A1 * 8/2010 Fling ..... E02F 9/245 324/326
2011/0146283 A1 * 6/2011 Narazaki ..... E02F 9/2246 60/701
2012/0031088 A1 * 2/2012 Takebayashi ..... E02F 9/2225 60/452
2012/0310492 A1 * 12/2012 Karasawa ..... E02F 9/2292 701/50
2015/0233086 A1 * 8/2015 Takaura ..... E02F 9/2285 414/685
2019/0219071 A1 * 7/2019 Itou ..... E02F 9/20
2020/0024821 A1 * 1/2020 Takeuchi ..... E02F 9/2228
2020/0087892 A1 * 3/2020 Kamiya ..... E02F 9/2246
2020/0165799 A1 * 5/2020 Wu ..... E02F 3/651

OTHER PUBLICATIONS

International Search Report of PCT/JP2017/039400 dated Jan. 9, 2018.

* cited by examiner

WORK MACHINE

TECHNICAL FIELD

The present invention relates to a work machine that performs front implement control performing area limiting excavation control, for example.

BACKGROUND ART

In a work machine such as a hydraulic excavator or the like, a front work implement is operated typically by performing combined operation of a plurality of operation lever devices. However, it is highly difficult for an inexperienced operator to operate the operation lever devices skillfully so as not to excavate beyond an excavation target surface while operating the front work implement within a predetermined region.

Recently, work machines that perform front implement control limiting the operation of a front work implement on the basis of a bucket position or the like have been put to service in a widening range of situations. When the front implement control acts, the operation of the front work implement is limited so as not to excavate below an excavation target surface. As a related technology, a technology has been proposed which provides a solenoid proportional valve to the operation signal line of an operation lever device, and reduces the pressure of a hydraulic signal output from the operation lever device by the solenoid proportional valve such that the speed of the front work implement does not exceed a limiting value (see Patent Document 1 and the like).

PRIOR ART DOCUMENT

Patent Document

Patent Document 1: Japanese Patent No. 3091667

SUMMARY OF THE INVENTION

Problem to be Solved by the Invention

A responsiveness to a lever operation is required of a hydraulic excavator, for example, at a time of a so-called rapid shaking work that sorts contents such as soil or the like by shaking a bucket in small motions. Also in so-called slope tamping work as work of forming a face of slope, a responsiveness may be required for an improvement in efficiency of an operation of raising and lowering a boom quickly.

However, with the technology described in Patent Document 1, the solenoid proportional valve is present on the operation signal line. The solenoid proportional valve involves a pressure loss even at a maximum opening degree. Therefore, in a work machine having a front implement control function, as compared with a work machine not having the function, responsiveness of actuators in response to a lever operation can be decreased due to a pressure loss of the solenoid proportional valve even when the front implement control does not act.

It is an object of the present invention to provide a work machine in which responsiveness of actuators in response to an operation and a front implement control function can be made compatible with each other.

Means for Solving the Problem

In order to achieve the above object, according to the present invention, there is provided a work machine including: a machine body; a front work implement provided to the machine body; a plurality of actuators configured to drive the front work implement; a posture sensor configured to detect a posture of the front work implement; a hydraulic pump configured to deliver a hydraulic operating oil that drives the actuators; a plurality of control valves configured to control flows of the hydraulic operating oil supplied from the hydraulic pump to the corresponding actuators; a plurality of operation lever devices configured to generate hydraulic signals to be output to the corresponding control valves according to respective operations; a pilot line configured to connect the operation lever devices to the corresponding control valves; a pilot pump configured to supply a hydraulic operating oil to the operation lever devices; at least one solenoid proportional valve provided to the pilot line, the at least one solenoid proportional valve reducing pressure of one of the hydraulic signals generated by a corresponding operation lever device; and a front implement control section configured to limit operation of the front work implement by controlling the solenoid proportional valve on a basis of a detection signal of the posture sensor; the pilot line including a plurality of operation signal lines connected to signal output valves of the corresponding operation lever devices, a plurality of signal input lines connected to hydraulic driving sections of the corresponding control valves, and at least one pressure reducing line provided with the solenoid proportional valve, and the pilot line having at least one selector valve disposed between an operation signal line and the corresponding pressure reducing line, the at least one selector valve having a first position that interrupts connection of the operation signal line and the corresponding pressure reducing line and directly connects the operation signal line to a corresponding signal input line, and a second position that interrupts the direct connection of the operation signal line and a corresponding signal input line and connects the operation signal line to the signal input line via the corresponding pressure reducing line.

Effects of the Invention

According to the present invention, responsiveness of actuators in response to an operation and a front implement control function can be made compatible with each other.

MODES FOR CARRYING OUT THE INVENTION

Embodiments of the present invention will hereinafter be described with reference to the drawings.

First Embodiment 1-1. Work Machine

Figure 1:
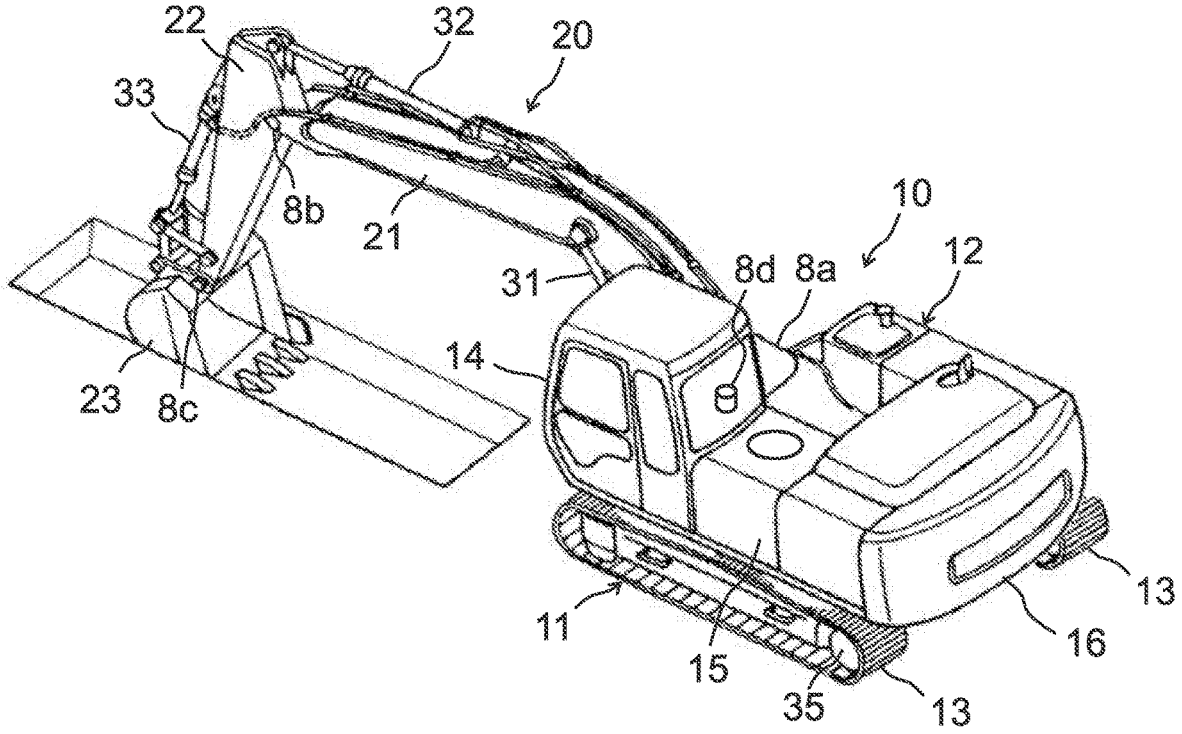
FIG. 1 is a perspective view illustrating an external appearance of a work machine according to a first embodiment of the present invention.

FIG. 1 is a perspective view illustrating an external appearance of a work machine according to a first embodiment of the present invention. In the present embodiment, a hydraulic excavator equipped with a bucket 23 as an attachment at a front end of a front work implement will be described as an example of the work machine. However, the present invention can be applied also to other kinds of work machines such as a hydraulic excavator having an attachment other than a bucket, a bulldozer, and the like. Hereinafter, a front side (upper left side in FIG. 1), a rear side (lower right side in FIG. 1), a left side (lower left side in FIG. 1), and a right side (upper right side in FIG. 1) as viewed from an operator sitting on a cab seat will be set as a front, a rear, a left, and a right of the hydraulic excavator, and will be described simply as a front side, a rear side, a left side, and a right side, respectively.

The hydraulic excavator illustrated in the figure includes a machine body 10 and a front work implement 20. The machine body 10 includes a track structure 11 and a swing structure 12.

The track structure 11 in the present embodiment has a left crawler and a right crawler (travelling driving body) 13 having an endless track crawler belt. The track structure 11 travels when a left travelling motor 35 and a right travelling motor 35 drive the left and right crawlers 13, respectively. A hydraulic motor, for example, is used as the travelling motors 35.

Figure 2:
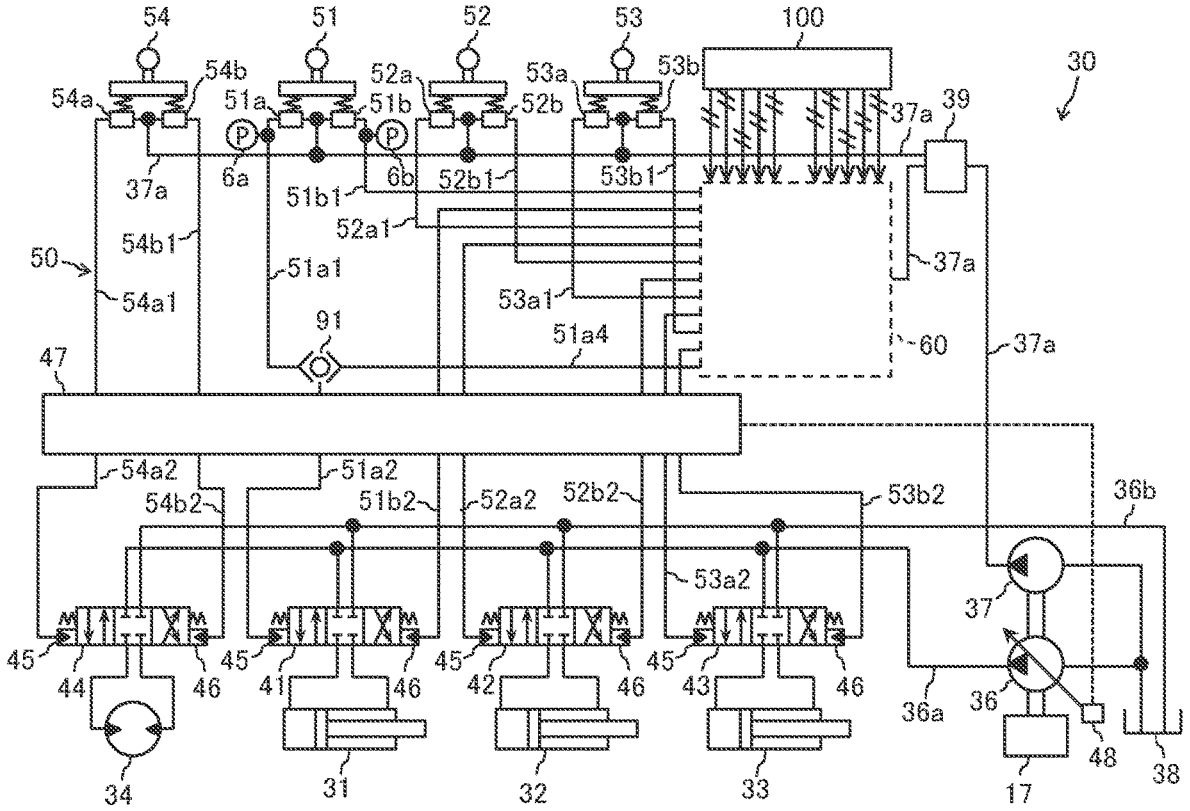
FIG. 2 is a diagram illustrating a hydraulic drive system included in the hydraulic excavator illustrated in FIG. 1 together with a controller unit.

The swing structure 12 is disposed on the track structure 11 so as to be swingable via a swing device (not illustrated). An operation room 14 that an operator gets into is disposed in a front portion (front left side in the present embodiment) of the swing structure 12. A power chamber 15 housing a prime mover 17 (FIG. 2), a hydraulic drive system, and the like is mounted on a rear side of the operation room 14 in the swing structure 12. A counterweight 16 that adjusts a balance in a front-rear direction of a machine body is mounted in a rearmost portion of the swing structure 12. The prime mover 17 is an engine (internal combustion engine) or a motor. The swing device that couples the swing structure 12 to the track structure 11 includes a swing motor 34 (FIG. 2). The swing motor 34 swing-drives the swing structure 12 with respect to the track structure 11. The swing motor 34 in the present embodiment is a hydraulic motor. However, an electric motor may be used as the swing motor 34, or both of a hydraulic motor and an electric motor may be used as the swing motor 34.

The front work implement 20 is a device for performing work such as excavation of a soil or the like. The front work implement 20 is provided to the front portion of the swing structure 12 (on the right side of the operation room 14 in the present embodiment). The front work implement 20 is an articulated work device having a boom 21, an arm 22, and a bucket 23. The boom 21 is coupled to a frame of the swing structure 12 by a pin (not illustrated) extending in a left-right direction, and is also coupled to the swing structure 12 by a boom cylinder 31. The boom 21 is configured to rotate vertically with respect to the swing structure 12 as the boom cylinder 31 is expanded or contracted. The arm 22 is coupled to a front end of the boom 21 by a pin (not illustrated) extending in the left-right direction, and is also coupled to the boom 21 by an arm cylinder 32. The arm 22 is configured to rotate with respect to the boom 21 as the arm cylinder 32 is expanded or contracted. The bucket 23 is coupled to a front end of the arm 22 by a pin (not illustrated) extending horizontally in the left-right direction, and is coupled to the arm 22 via a bucket cylinder 33 and a link. The bucket 23 is configured to rotate with respect to the arm 22 as the bucket cylinder 33 is expanded or contracted. The boom cylinder 31, the arm cylinder 32, and the bucket cylinder 33 are a hydraulic cylinder that drives the front work implement 20.

In addition, the hydraulic excavator is provided with sensors that detect information about a position and a posture at appropriate positions. For example, angle sensors 8*a* to 8*c* are respectively provided at respective rotation pivots of the boom 21, the arm 22, and the bucket 23. The angle sensors 8*a* to 8*c* are used as posture sensors that detect information about the position and posture of the front work implement 20. The angle sensors 8*a* to 8*c* detect the rotational angles of the boom 21, the arm 22, and the bucket 23, respectively. In addition, the swing structure 12 is provided with an inclination sensor 8*d*, positioning devices 9*a* and 9*b* (FIG. 4), a radio set 9*c* (FIG. 4), a hydraulic drive system 30 (FIG. 2), and a controller unit 100 (FIG. 2 or the like). The inclination sensor 8*d* is used as posture detecting means for the swing structure 12, the means detecting an inclination in at least one of the front-rear direction and the left-right direction of the swing structure 12. An RTK-GNSS (Real Time Kinematic-Global Navigation Satellite System), for example, is used as the positioning devices 9*a* and 9*b*. The positional information of the machine body 10 is obtained by the positioning devices 9*a* and 9*b*. The radio set 9*c* receives correction information from a reference station GNSS (not illustrated). The positioning devices 9*a* and 9*b* and the radio set 9*c* are means detecting the position and orientation of the swing structure 12. Further, at least one lever portion of an operating panel (not illustrated) and operation lever devices 51 to 54 (FIG. 2 and the like) within the operation room 14 is provided with a switch 7 (see FIG. 3) that turns on and off control of a front implement control section 120. The hydraulic drive system 30 and the controller unit 100 will be described next.

1-2. Hydraulic Drive System

FIG. 2 is a diagram illustrating the hydraulic drive system included in the hydraulic excavator illustrated in FIG. 1 together with the controller unit. In the figure, parts already described are identified by the same reference characters as in the aforementioned drawings, and description thereof will be omitted.

The hydraulic drive system 30 is a system that drives driven members of the hydraulic excavator. The hydraulic drive system 30 is housed in the power chamber 15. The driven members include the front work implement 20 (the boom 21, the arm 22, and the bucket 23) and the machine body 10 (the crawlers 13 and the swing structure 12). The hydraulic drive system 30 includes actuators 31 to 34, a hydraulic pump 36, control valves 41 to 44, a pilot pump 37, operation lever devices 51 to 54, a front implement controlling hydraulic unit 60, and the like.

1-2. 1. Actuators

The actuators 31 to 34 respectively refer to the boom cylinder 31, the arm cylinder 32, the bucket cylinder 33, and the swing motor 34. The travelling motors 35 are not illustrated in FIG. 2. When a plurality of the boom cylinder 31, the arm cylinder 32, the bucket cylinder 33, the swing motor 34, and the travelling motors 35 are mentioned, the plurality may be described as "actuators 31 to 35," "actuators 31 and 32," or the like. The actuators 31 to 35 are driven by a hydraulic operating oil delivered from the hydraulic pump 36.

1-2. 2. Hydraulic Pump

The hydraulic pump 36 is a variable displacement pump that delivers the hydraulic operating oil driving the actuators 31 to 35 or the like. The hydraulic pump 36 is driven by the prime mover 17. The prime mover 17 in the present embodiment is an engine that converts the combustion energy of an internal combustion engine or the like into power. FIG. 2 illustrates only one hydraulic pump 36. However, a plurality of hydraulic pumps may be provided. The hydraulic operating oil delivered from the hydraulic pump 36 flows through a delivery pipe 36*a*, and is supplied to each of the actuators 31 to 34 via the control valves 41 to 44. Each return oil from the actuators 31 to 34 flows into a return oil pipe 36*b* via the control valves 41 to 44, respectively, and is returned to a tank 38. The delivery pipe 36*a* is provided with a relief valve (not illustrated) that regulates a maximum pressure of the delivery pipe 36*a*. Though not illustrated in FIG. 2, the travelling motor 35 is also driven by a similar circuit configuration. In a case where a blade is provided to at least one of the front and rear of the track structure 11, and in a case where an attachment having an actuator such as a breaker or the like is fitted to the front work implement 20 in place of the bucket 23, the actuators of the blade and the attachment are also driven by a similar circuit configuration.

1-2. 3. Control Valves

The control valves 41 to 44 are hydraulically operated flow control valves that control flows (directions and flow rates) of the hydraulic operating oil supplied from the hydraulic pump 36 to the corresponding actuators. The control valves 41 to 44 are each provided with hydraulic driving sections 45 and 46 to which a hydraulic signal is input. The control valve 41 is for the boom cylinder, the control valve 42 is for the arm cylinder, the control valve 43 is for the bucket cylinder, and the control valve 44 is for the swing motor. A control valve for the travelling motor is not illustrated. The hydraulic driving section 45 or 46 of the control valves 41 to 44 is connected to the corresponding operation lever device via a pilot line 50. The pilot line 50 includes operation signal lines 51*a*1, 51*b*1, 52*a*1, 52*b*1, 53*a*1, 53*b*1, 54*a*1, and 54*b*1, signal input lines 51*a*2, 51*b*2, 52*a*2, 52*b*2, 53*a*2, 53*b*2, 54*a*2, and 54*b*2, and pressure reducing lines 51*b*3, 52*a*3, 52*b*3, 53*a*3, and 53*b*3. The control valves 41 to 44 are configured to be moved to the right or to the left in the figure when the hydraulic signal is input to the hydraulic driving section 45 or 46 (excitation), and return to a neutral position by the force of a spring when the input of the hydraulic signal is stopped (demagnetization). For example, when the hydraulic signal is input to the hydraulic driving section 45 of the control valve 41 for the boom cylinder, a spool of the control valve 41 is moved to the right in FIG. 2 by a distance corresponding to the amplitude of the hydraulic signal. Thus, the hydraulic operating oil having a flow rate corresponding to the hydraulic signal is supplied to a bottom side oil chamber of the boom cylinder 31, and the boom 21 rises with the boom cylinder 31 extended at a speed corresponding to the amplitude of the hydraulic signal.

1-2. 4. Pilot Pump

The pilot pump 37 is a fixed displacement pump that delivers the hydraulic operating oil driving control valves such as the control valves 41 to 44 or the like. The pilot pump 37 is driven by the prime mover 17 as with the hydraulic pump 36. The pilot pump 37 can be configured to be driven by a power source other than the prime mover 17. A pump line 37*a* is a delivery pipe for the pilot pump 37. The pump line 37*a* passes through a lock valve 39, and then branches into a plurality of lines, which are connected to the operation lever devices 51 to 54 and the front implement controlling hydraulic unit 60. As will be described later in FIG. 3, within the front implement controlling hydraulic unit 60, the pump line 37*a* is connected to a system coupled to the hydraulic driving sections of specific control valves (the control valves 41 and 43 in the present example). The hydraulic operating oil delivered from the pilot pump 37 is supplied via the pump line 37*a* to the operation lever devices 51 to 54 and the hydraulic driving sections of the specific control valves.

Incidentally, the lock valve 39 in the present example is an electromagnetic selector valve, and an electromagnetic driving section thereof is electrically connected to a position sensor of a gate lock lever (not illustrated) disposed in the operation room 14 (FIG. 1). The gate lock lever is a bar installed on a boarding and alighting side of the cab seat so that the bar in a laid-down closed posture prevents the operator from alighting from the vehicle. The operator cannot alight from the vehicle unless the operator opens a boarding and alighting section for the cab seat by raising the gate lock lever. As the position of the gate lock lever, the laid-down posture will be described as a "lock released position" of an operating system, and the raised posture will be described as a "lock position" of the operating system. The position of the gate lock lever is detected by the position sensor, and a signal corresponding to the position of the gate lock lever is input from the position sensor to the lock valve 39. When the gate lock lever is in the lock position, the lock valve 39 is closed to interrupt the pump line 37*a*. When the gate lock lever is in the lock released position, the lock valve 39 is opened to open the pump line 37*a*. In the state in which the pump line 37*a* is interrupted, the source pressure of the hydraulic signal is cut off, and therefore hydraulic signals are not input to the control valves 41 to 44 irrespective of the presence or absence of operation. That is, operation by the operation lever devices 51 to 54 is disabled, and operation such as swing, excavation, and the like is prohibited.

1-2. 5. Operation Lever Device

The operation lever devices 51 to 54 are lever-operated operation devices that generate and output hydraulic signals giving instructions for operation of the corresponding actuators 31 to 34, respectively, according to an operation. The operation lever devices 51 to 54 are disposed in the operation room 14 (FIG. 1). The operation lever device 51 is for boom operation, the operation lever device 52 is for arm operation, the operation lever device 53 is for bucket operation, and the operation lever device 54 is for swing operation. In the case of the hydraulic excavator, typically, the operation lever devices 51 to 54 are cross-operated lever devices, and are configured such that an instruction for the operation of one actuator can be given by a tilting operation in the front-rear direction, and an instruction for the operation of another actuator can be given by a tilting operation in the left-right direction. Hence, the four operation lever devices 51 to 54 are divided into two groups of two operation lever devices each, and each group shares one lever section. Hence, the operation lever devices 51 to 54 have a total of two lever sections for right hand operation and for left hand operation. In a case where the above-described switch 7 is provided to a lever section, the switch 7 is provided to at least one of the two lever sections. An operation lever device for travelling is not illustrated.

The operation lever device 51 for boom operation has a signal output valve 51*a* for a boom raising command and a signal output valve 51*b* for a boom lowering command. The pump line 37*a* is connected to input ports (primary side ports) of the signal output valves 51*a* and 51*b*. An output port (secondary side port) of the signal output valve 51*a* for a boom raising command is connected to the hydraulic driving section 45 of the control valve 41 for the boom cylinder via the operation signal line 51*a*1 and the signal input line 51*a*2. An output port of the signal output valve 51*b* for a boom lowering command is connected to the hydraulic driving section 46 of the control valve 41 via the operation signal line 51*b*1 and the signal input line 51*b*2. When the operation lever device 51 is moved down to the boom raising command side, for example, the signal output valve 51*a* opens with an opening degree corresponding to an operation amount. Thus, the delivery oil of the pilot pump 37 which oil is input from the pump line 37*a* is reduced in pressure by the signal output valve 51*a* according to the operation amount, and is output as a hydraulic signal to the hydraulic driving section 45 of the control valve 41. Incidentally, the operation signal lines 51*a*1 and 51*b*1 are provided with pressure sensors 6*a* and 6*b*, respectively. The pressure sensors 6*a* and 6*b* detect the magnitudes (pressure values) of the hydraulic signals output by the signal output valves 51*a* and 51*b*.

Similarly, the operation lever device 52 for arm operation has a signal output valve 52*a* for an arm crowding command and a signal output valve 52*b* for an arm dumping command. The operation lever device 53 for bucket operation has a signal output valve 53*a* for a bucket crowding command and a signal output valve 53*b* for a bucket dumping command. The operation lever device 54 for swing operation has a signal output valve 54*a* for a right swing command and a signal output valve 54*b* for a left swing command.

Input ports of the signal output valves 52*a*, 52*b*, 53*a*, 53*b*, 54*a*, and 54*b* are connected to the pump line 37*a*. An output port of the signal output valve 52*a* of the operation lever device 52 for arm operation is connected to the hydraulic driving section 45 of the control valve 42 for the arm cylinder via the operation signal line 52*a*1 and the signal input line 52*a*2. An output port of the signal output valve 52*b* of the operation lever device 52 for arm operation is connected to the hydraulic driving section 46 of the control valve 42 for the arm cylinder via the operation signal line 52*b*1 and the signal input line 52*b*2. An output port of the signal output valve 53*a* for a bucket crowding command is connected to the hydraulic driving section 45 of the control valve 43 for the bucket cylinder via the operation signal line 53*a*1 and the signal input line 53*a*2. An output port of the signal output valve 53*b* for a bucket dumping command is connected to the hydraulic driving section 46 of the control valve 43 via the operation signal line 53*b*1 and the signal input line 53*b*2. An output port of the signal output valve 54*a* of the operation lever device 54 for swing operation is connected to the hydraulic driving section 45 of the control valve 44 for the swing motor via the operation signal line 54*a*1 and the signal input line 54*a*2. An output port of the signal output valve 54*b* of the operation lever device 54 for swing operation is connected to the hydraulic driving section 46 of the control valve 44 for the swing motor via the operation signal line 54*b*1 and the signal input line 54*b*2. An output principle of the hydraulic signals of the operation lever devices 52 to 54 is similar to that of the operation lever device 51 for boom operation.

Incidentally, in the present embodiment, a shuttle block 47 is disposed at midpoints of the signal input lines 51*a*2, 51*b*2, 52*a*2, 52*b*2, 53*a*2, 53*b*2, 54*a*2, and 54*b*2. The hydraulic signals output from the operation lever devices 51 to 54 are input also to a regulator 48 of the hydraulic pump 36 via the shuttle block 47. Though a detailed configuration of the shuttle block 47 is omitted, a delivery flow rate of the hydraulic pump 36 is controlled according to the hydraulic signals by inputting the hydraulic signals to the regulator 48 via the shuttle block 47.

1-2. 6. Front Implement Controlling Hydraulic Unit

Figure 3:
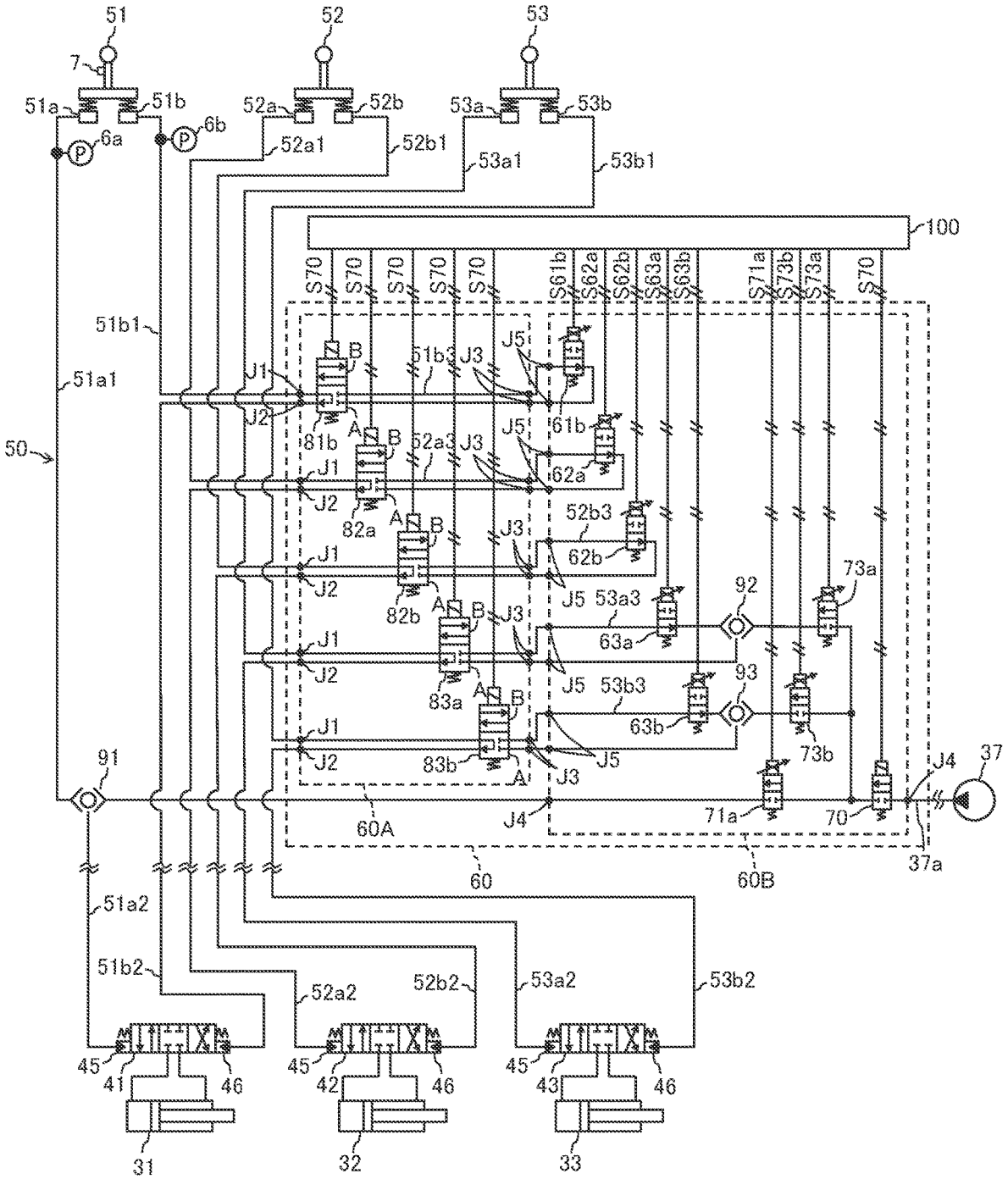
FIG. 3 is a hydraulic circuit diagram of a front implement controlling hydraulic unit provided to the hydraulic excavator illustrated in FIG. 1.

FIG. 3 is a hydraulic circuit diagram of the front implement controlling hydraulic unit. In the figure, elements identified by the same reference characters as in the other drawings are elements similar to the elements illustrated in the other drawings. As illustrated in the figure, the front implement controlling hydraulic unit 60 includes a selector valve unit 60A and a solenoid proportional valve unit 60B, and is driven by signals from the controller unit 100. The solenoid proportional valve unit 60B is hardware for increasing or reducing the pressure of the hydraulic signals output from the operation lever devices 51 to 53 according to conditions so that the front work implement 20 is prevented from performing excavation or the like beyond an excavation target surface. The selector valve unit 60A is hardware for switching as to whether or not paths of the hydraulic signals output from the operation lever devices 51 to 53 to the control valves 41 to 43 are routed through the solenoid proportional valve unit 60B.

The solenoid proportional valve unit 60B includes solenoid proportional valves 61*b*, 62*a*, 62*b*, 63*a*, and 63*b* for pressure reduction, solenoid proportional valves 71*a*, 73*a*, and 73*b* for pressure increase, a shut-off valve 70, and shuttle valves 92 and 93. The selector valve unit 60A includes selector valves 81*b*, 82*a*, 82*b*, 83*a*, and 83*b*. These elements will be described in order in the following.

Pressure Reducing Solenoid Proportional Valves

The solenoid proportional valves 61*b*, 62*a*, 62*b*, 63*a*, and 63*b* play a role of limiting maximum values of the hydraulic signals output from the corresponding signal output valves according to signals from the controller unit 100 in order to prevent excavation below the excavation target surface. These valves are normally open proportional valves. When the valves are demagnetized, the valves reach a maximum opening degree. When the valves are energized by signals from the controller unit 100, the valves decrease the opening degree (close) in proportion to the magnitudes of the signals. The solenoid proportional valves 61*b*, 62*a*, 62*b*, 63*a*, and 63*b* are provided to the pressure reducing lines 51*b*3, 52*a*3, 52*b*3, 53*a*3, and 53*b*3, respectively, and are positioned between the corresponding control valves and the corresponding operation lever devices in the pilot line 50.

Both ends of the pressure reducing line 51*b*3 are connected to the operation signal line 51*b*1 and the signal input line 51*b*2 for boom lowering operation via the selector valve 81*b*. The hydraulic signal generated by the signal output valve 51*b* for boom lowering operation is guided to the pressure reducing line 51*b*3. The solenoid proportional valve 61*b* is driven by a signal S61*b* of the controller unit 100, and limits a maximum value of the hydraulic signal for boom lowering operation.

Similarly, both ends of the pressure reducing line 52*a*3 are connected to the operation signal line 52*a*1 and the signal input line 52*a*2 for arm crowding operation via the selector valve 82*a*. The hydraulic signal generated by the signal output valve 52*a* for arm crowding operation is guided to the pressure reducing line 52*a*3. Both ends of the pressure reducing line 52*b*3 are connected to the operation signal line 52*b*1 and the signal input line 52*b*2 for arm dumping operation via the selector valve 82*b*. The hydraulic signal generated by the signal output valve 52*b* for arm dumping operation is guided to the pressure reducing line 52*b*3. Both ends of the pressure reducing line 53*a*3 are connected to the operation signal line 53*a*1 and the signal input line 53*a*2 for bucket crowding operation via the selector valve 83*a*. The hydraulic signal generated by the signal output valve 53*a* for bucket crowding operation is guided to the pressure reducing line 53*a*3. Both ends of the pressure reducing line 53*b*3 are connected to the operation signal line 53*b*1 and the signal input line 53*b*2 for bucket dumping operation via the selector valve 83*b*. The hydraulic signal generated by the signal output valve 53*b* for bucket dumping operation is guided to the pressure reducing line 53*b*3. The solenoid proportional valves 62*a*, 62*b*, 63*a*, and 63*b* are driven by signals S62*a*, S62*b*, S63*a*, and S63*b* of the controller unit 100, and respectively limit maximum values of the corresponding hydraulic signals.

Shuttle Valves

In addition to the shuttle valves 92 and 93 included in the solenoid proportional valve unit 60B, a shuttle valve 91 is also used outside the front implement controlling hydraulic unit 60 in the present embodiment. The shuttle valves 91 to 93 are high pressure selection valves. The shuttle valves 91 to 93 each include two inlet ports and one outlet port.

One inlet port of the shuttle valve 91 is connected to the operation signal line 51*a*1 for boom raising operation. The other inlet port of the shuttle valve 91 is connected to the pump line 37*a* without the intervention of a signal output valve. The outlet port of the shuttle valve 91 is connected to the signal input line 51*a*2 for boom raising operation.

The shuttle valve 92 is provided to the pressure reducing line 53*a*3 for bucket crowding operation. That is, one inlet port of the shuttle valve 92 is connected to the operation signal line 53*a*1 for bucket crowding operation, and the outlet port of the shuttle valve 92 is connected to the signal input line 53*a*2 for bucket crowding operation. The other inlet port of the shuttle valve 92 is connected to the pump line 37*a* without the intervention of a signal output valve.

The shuttle valve 93 is provided to the pressure reducing line 53*b*3 for bucket dumping operation. That is, one inlet port of the shuttle valve 93 is connected to the operation signal line 53*b*1 for bucket dumping operation, and the outlet port of the shuttle valve 93 is connected to the signal input line 53*b*2 for bucket dumping operation. The other inlet port of the shuttle valve 93 is connected to the pump line 37*a* without the intervention of a signal output valve.

Solenoid Proportional Valves for Pressure Increase

The solenoid proportional valves 71*a*, 73*a*, and 73*b* play a role of outputting hydraulic signals not dependent on operation of the operation lever devices according to signals of the controller unit 100 by bypassing the operation lever devices. These valves are normally closed proportional valves. When the valves are demagnetized, the valves reach a minimum opening degree (zero opening degree). When the valves are energized by the signals from the controller unit 100, the valves increase the opening degree (open) in proportion to the magnitudes of the signals. The solenoid proportional valves 71*a*, 73*a*, and 73*b* are provided to the pump line 37*a* that branches and is coupled to the respective shuttle valves 91 to 93. Hydraulic signals input from the solenoid proportional valves 71*a*, 73*a*, and 73*b* to the inlet ports on the other side of the shuttle valves 91 to 93 interfere with the hydraulic signals input from the operation lever devices 51 and 53 to the inlet ports on one side of the shuttle valves 91 to 93. The solenoid proportional valves 71*a*, 73*a*, and 73*b* will be referred to as solenoid proportional valves for pressure increase in the specification of the present application in that the solenoid proportional valves 71*a*, 73*a*, and 73*b* can output hydraulic signals of higher pressure than the hydraulic signals output from the operation lever devices 51 and 53.

Specifically, the solenoid proportional valve 71*a* is driven by a signal S71*a* of the controller unit 100, and outputs a hydraulic signal that commands a boom automatic raising operation. When an opening command signal is output to the solenoid proportional valve 71*a*, a closing command signal is output to the solenoid proportional valve 61*b* for normal pressure reduction, so that the solenoid proportional valve 61*b* is closed when the solenoid proportional valve 71*a* is opened. In this case, even if a boom lowering operation is performed, a hydraulic signal is input only to the hydraulic driving section 45 of the control valve 41, so that a boom raising operation is forcibly performed. The solenoid proportional valve 71*a* functions, for example, when excavation is performed below the excavation target surface.

The solenoid proportional valve 73*a* is driven by a signal S73*a* of the controller unit 100, and outputs a hydraulic signal that commands a bucket crowding operation. The solenoid proportional valve 73*b* is driven by a signal S73*b* of the controller unit 100, and outputs a hydraulic signal that commands a bucket dumping operation. The hydraulic signals output by the solenoid proportional valves 73*a* and 73*b* are signals that correct the posture of the bucket 23. When these hydraulic signals are selected by the shuttle valves 92 and 93 and input to the control valve 43, the posture of the bucket 23 is corrected so as to have a fixed angle with respect to the excavation target surface.

Shut-Off Valve

The shut-off valve 70 is an electromagnetically driven opening and closing valve of a normally closed type. When the shut-off valve 70 is demagnetized, the shut-off valve 70 fully closes (zero opening degree). When the shut-off valve 70 is energized by receiving a signal from the controller unit 100, the shut-off valve 70 opens. The shut-off valve 70 is disposed between a branching portion of the branches coupled to the shuttle valves 91 to 93 in the pump line 37*a* and the lock valve 39 (FIG. 2). When the shut-off valve 70 is closed by a command signal from the controller unit 100, the generation and output of the hydraulic signals not dependent on operation of the operation lever devices 51 and 53 is prohibited.

Selector Valves

The selector valves 81*b*, 82*a*, 82*b*, 83*a*, and 83*b* play a role of switching between connection and interruption of the pressure reducing lines to and from the corresponding operation signal lines and the corresponding signal input lines. The selector valves 81*b*, 82*a*, 82*b*, 83*a*, and 83*b* are respectively arranged between the corresponding operation signal lines and the corresponding signal input lines and the pressure reducing lines. These valves each have two switching positions, that is, a first position A and a second position B. The valves are switched to the first position A in a demagnetized state. When the valves are energized by receiving signals from the controller unit 100, the valves are switched to the second position B.

The first position A is a position that interrupts connection between an operation signal line and a corresponding pressure reducing line and connects the operation signal line directly to a corresponding signal input line. The selector valves 81*b*, 82*a*, 82*b*, 83*a*, and 83*b* are connected on one side with the corresponding operation signal lines and the corresponding pressure reducing lines, and are connected on another side with the corresponding pressure reducing lines. That is, a return flow passage is formed at the first position A. When the selector valves are switched to the first position A, the hydraulic signals input from the one side to the selector valves are output from the one side, and the hydraulic signals are not at all input to the pressure reducing lines interrupted in terms of circuitry nor, in turn, the solenoid proportional valve unit 60B.

The second position B is a position that interrupts direct connection between the operation signal line and the corresponding signal input line and connects the operation signal line to the signal input line via the corresponding pressure reducing line. Formed at the second position B are two flow passages that are connected to end portions of the corresponding pressure reducing line and circulate the hydraulic operating oil in mutually opposite directions. When the selector valves are switched to the second position B, the hydraulic signals input from the one side to the selector valves are output to the pressure reducing lines on the other side. The hydraulic signals input to the pressure reducing lines are passed through the solenoid proportional valves for pressure reduction, then returned, input to the selector valves again from the other side, and output to the corresponding signal input lines.

As described above, the selector valves 81*b*, 82*a*, 82*b*, 83*a*, and 83*b* are connected in series with the corresponding solenoid proportional valves for pressure reduction. When the selector valves 81*b*, 82*a*, 82*b*, 83*a*, and 83*b* are switched to the second position B, the hydraulic signals are transmitted through the corresponding pressure reducing lines. When the selector valves 81*b*, 82*a*, 82*b*, 83*a*, and 83*b* are switched to the first position A, the transmission paths of the hydraulic signals are short-cut at the first position A.

Selector Valve Unit and Solenoid Proportional Valve Unit

As described earlier, the selector valve unit 60A is a valve unit including the selector valves 81*b*, 82*a*, 82*b*, 83*a*, and 83*b*. As in FIG. 3, the selector valve unit 60A is provided with one side of each of joints J1 within the paths of the operation signal lines, joints J2 within the paths of the signal input lines, and joints J3 within the paths of the pressure reducing lines. When the coupling of the joints J1 to J3 is released, the selector valve unit 60A can be independently detached from the circuit of FIG. 3.

The solenoid proportional valve unit 60B is a valve unit including the solenoid proportional valves 61*b*, 62*a*, 62*b*, 63*a*, 63*b*, 71*a*, 73*a*, and 73*b*, the shut-off valve 70, and the shuttle valves 92 and 93. As in FIG. 3, the solenoid proportional valve unit 60B is provided with one sides of joints J4 within the path of the pump line and joints J5 within the paths of the pressure reducing lines. The solenoid proportional valve unit 60B can also be independently detached from the circuit of FIG. 3 when the coupling of the joints J4 and J5 is released.

1-2. 7. Controller Unit

Figure 4:
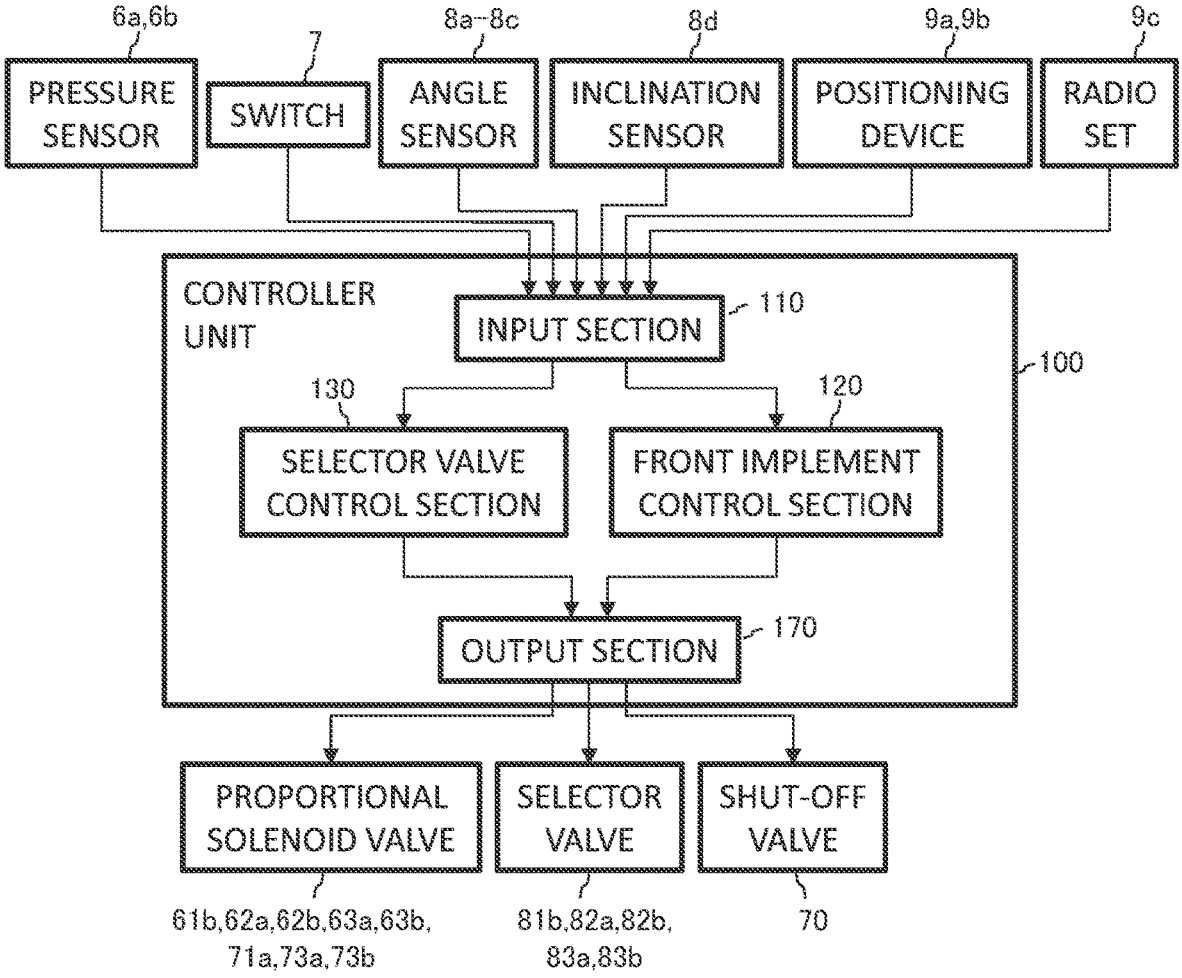
FIG. 4 is a functional block diagram of the controller unit provided to the hydraulic excavator illustrated in FIG. 1.

FIG. 4 is a functional block diagram of the controller unit. As illustrated in the figure, the controller unit 100 includes functional sections such as an input section 110, a front implement control section 120, a selector valve control section 130, and an output section 170. Each of the functional sections will be described in the following.

Input Section/Output Section

The input section 110 is a functional section to which signals from the sensors and the like are input. Input to the input section 110 are signals from the pressure sensors 6*a* and 6*b*, the switch 7, the angle sensors 8*a* to 8*c*, the inclination sensor 8*d*, the positioning devices 9*a* and 9*b*, the radio set 9*c*, and the like.

The output section 170 is a functional section that outputs command signals generated in the front implement control section 120 and the selector valve control section 130 to the front implement controlling hydraulic unit 60, and thereby controls corresponding valves. The valves that can be a control target are the solenoid proportional valves 61*b*, 62*a*, 62*b*, 63*a*, 63*b*, 71*a*, 73*a*, and 73*b*, the selector valves 81*b*, 82*a*, 82*b*, 83*a*, and 83*b*, and the shut-off valve 70.

Front Implement Control Section

The front implement control section 120 is a functional section that computes a limiting command value that limits the operation of the front work implement 20 so as not to excavate beyond the excavation target surface (below the excavation target surface) on the basis of signals of the angle sensors 8*a* to 8*c* and the inclination sensor 8*d*. Front implement control is a general term for control that controls the front implement controlling hydraulic unit 60 according to a distance between the excavation target surface and a specific point of the bucket 23, extension or contraction speed of the actuators 31 to 33, and the like. For example, control that controls at least one of the solenoid proportional valves 61*b*, 62*a*, 62*b*, 63*a*, and 63*b* for pressure reduction and decelerates the operation of at least one of the actuators 31 to 33 in the vicinity of the excavation target surface is also one of front implement controls. Also included in front implement control is boom automatic raising control that controls at least one of the solenoid proportional valves 71*a*, 73*a*, and 73*b* for pressure increase and forcibly performs a boom raising operation in a situation in which the lower side of the excavation target surface is excavated, and control that holds the angle of the bucket 23 constant. In addition, so-called boom lowering stop control, bucket pressure increasing control, and the like are also included. In addition, controlling at least one of the solenoid proportional valves 61*b*, 62*a*, 62*b*, 63*a*, and 63*b* for pressure reduction and at least one of the solenoid proportional valves 71*a*, 73*a*, and 73*b* for pressure increase in a composite manner is also included in front implement control. Further, in the specification of the present application, so-called locus control that controls a locus described by the front work implement 20 to a fixed locus is also one of front implement controls. Description of details of the front implement control section 120 will be omitted. However, a publicly known technology described in, for example, JP-H08-333768-A, JP-2016-003442-A, and the like can be applied to the front implement control section 120 as appropriate.

Selector Valve Control Section

Figure 5:
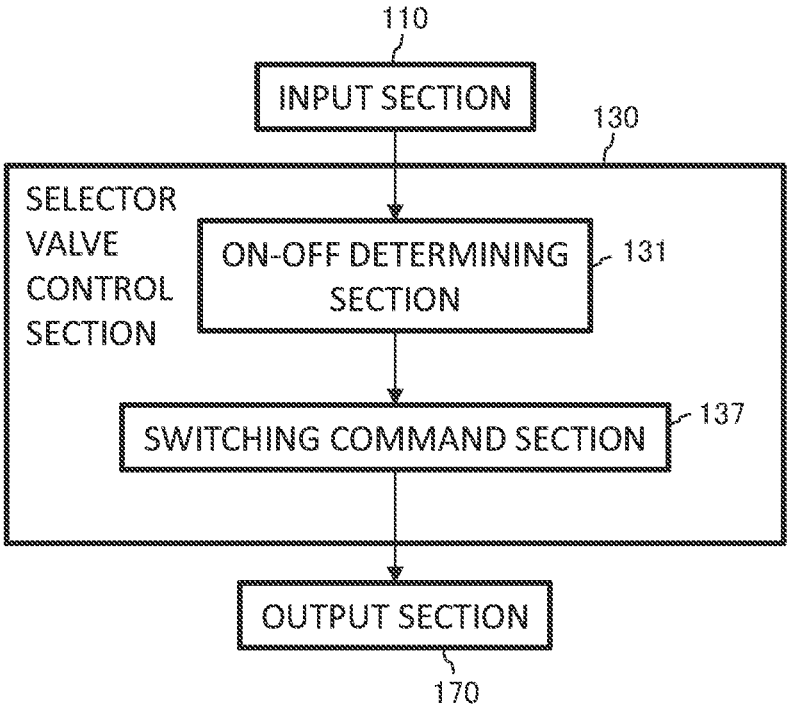
FIG. 5 is a functional block diagram of a selector valve control section provided to the hydraulic excavator illustrated in FIG. 1.

FIG. 5 is a functional block diagram of the selector valve control section. As illustrated in the figure, the selector valve control section 130 is a functional section that controls the selector valves 81*b*, 82*a*, 82*b*, 83*a*, and 83*b*, and the selector valve control section 130 includes an on-off determining section 131 and a switching command section 137.

The on-off determining section 131 is a functional section that determines whether a signal input from the switch 7 via the input section 110 is an on signal that sets the control of the front implement control section 120 in an on state or an off signal that sets the control of the front implement control section 120 in an off state.

The switching command section 137 is a functional section that selectively generates a command signal that switches the selector valves 81*b*, 82*a*, 82*b*, 83*a*, and 83*b* to the first position A and a command signal that switches the selector valves 81*b*, 82*a*, 82*b*, 83*a*, and 83*b* to the second position B. Specifically, when the on-off determining section 131 determines that the signal input from the switch 7 is an off signal, the switching command section 137 generates signals S70 that switch all of the selector valves to the first position A. Conversely, when the on-off determining section 131 determines that the signal input from the switch 7 is an on signal, the switching command section 137 generates the signals S70 that switch all of the selector valves to the second position B.

Incidentally, in the present embodiment, the command signals S70 output to the selector valves 81*b*, 82*a*, 82*b*, 83*a*, and 83*b* and the shut-off valve 70 are signals having a same value. When the signals S70 switch the selector valves to the first position A, the command signals S70 in the present embodiment are demagnetizing signals (stopping of energizing current), and the shut-off valve 70 of a normally closed type is set in an interrupting position. Conversely, when the signals S70 switch the selector valves to the second position B, the command signals S70 in the present embodiment are energizing signals (output of the energizing current), and the shut-off valve 70 of a normally closed type is set in an open position.

1-3 Operation

Figure 6:
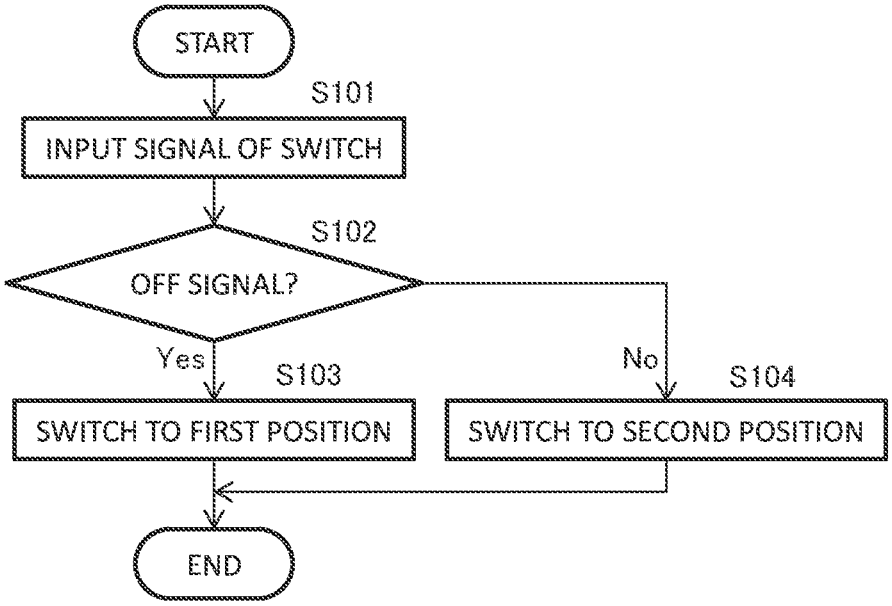
FIG. 6 is a flowchart illustrating a selector valve control procedure of the selector valve control section illustrated in FIG. 5.

FIG. 6 is a flowchart illustrating a selector valve control procedure of the selector valve control section. Suppose that during operation, the selector valve control section 130 repeats the procedure of FIG. 6 in predetermined processing cycles (for example 0.1 s). First, the signal of the switch 7 is input via the input section 110 (step S101), and the on-off determining section 131 determines whether the signal is an on signal or an off signal (step S102). When the signal of the switch 7 is an off signal, the selector valve control section 130 generates a signal that switches each selector valve to the first position A in the switching command section 137, and outputs the signal via the output section 170. Each operation signal line is thereby directly connected to the corresponding signal input line without the intervention of the pressure reducing line. The procedure of FIG. 6 is then ended (step S103). When the signal of the switch 7 is an on signal, the selector valve control section 130 generates a signal that switches each selector valve to the second position B in the switching command section 137, and outputs the signal via the output section 170. Each operation signal line is thereby connected to the corresponding signal input line via the pressure reducing line. The procedure of FIG. 6 is then ended (step S104). When the switch 7 is operated to set the function of front implement control in an on state by the procedure of FIG. 6, the selector valves 81*b*, 82*a*, 82*b*, 83*a*, and 83*b* are switched to the second position B, and each pressure reducing line is connected to the corresponding operation signal line. Conversely, when the switch 7 is operated to set the function of front implement control in an off state, the selector valves 81*b*, 82*a*, 82*b*, 83*a*, and 83*b* are switched to the first position A, and each pressure reducing line is isolated from the corresponding operation signal line.

1-3. 1. When Front Implement Control is Enabled

When a boom lowering operation is performed by the operation lever device 51, for example, the signal output valve 51*b* for a boom lowering command opens according to an operation amount, and a hydraulic signal is input to the hydraulic driving section 46 of the control valve 41 for the boom cylinder via the operation signal line 51*b*1. Thus, the boom cylinder 31 is contracted, so that a boom lowering operation is performed. When the function of front implement control is in an on state, depending on the distance between the bucket 23 of the excavation target surface and a lowering speed of the bucket 23, the opening degree of the solenoid proportional valve 61*b* is limited by a limiting command value output from the front implement control section 120, and therefore a maximum value of the hydraulic signal is limited. When the hydraulic signal exceeds a limiting value defined by the opening degree of the solenoid proportional valve 61*b*, the hydraulic signal is pressure-reduced to the limiting value by the solenoid proportional valve 61*b* in a process of circulating through the pressure reducing line 51*b*3. As a result, the boom lowering operation is reduced in speed from an original speed based on the operation amount, and the bucket 23 is prevented from entering the lower side of the excavation target surface.

The same is true for operations of outputting pressure signals to the other operation signal lines via the selector valves (respective operations of arm crowding, arm dumping, bucket crowding, and bucket dumping).

1-3. 2. When Front Implement Control is Disabled

When a boom lowering operation is performed by the operation lever device 51, for example, the signal output valve 51*b* for a boom lowering command opens according to an operation amount. When the front implement control function is in an off state, the solenoid proportional valve 61*b* has a maximum opening degree without depending on the position of the bucket 23 or the like, but the operation signal line 51*b*1 and the pressure reducing line 51*b*3 are interrupted from each other. Hence, the whole of the hydraulic signal output from the signal output valve 51*b* directly flows into the signal input line 51*b*2 without flowing into the pressure reducing line 51*b*3, and is input to the hydraulic driving section 46 of the control valve 41 for the boom cylinder.

The same is true for operations of outputting pressure signals to the other operation signal lines via the selector valves (respective operations of arm crowding, arm dumping, bucket crowding, and bucket dumping).

1-4. Effect

If the pressure reducing lines are connected to the operation signal lines and the signal input lines without the intervention of the selector valves, the hydraulic signals always pass through the solenoid proportional valves in these pipes. In this case, when normal excavation work is performed with the function of front implement control off, losses of the hydraulic signals are increased by amounts of pressure losses of the solenoid proportional valves as compared with a hydraulic excavator not having the front implement control function (which hydraulic excavator will be described here as a "standard machine" for convenience). Therefore, responsiveness of operation of the actuators 31 to 33 in response to operation of the operation lever devices 51 to 53 becomes lower than that of the standard machine.

Accordingly, in the present embodiment, the pressure reducing lines are connected to the operation signal lines and the signal input lines via the selector valves, and the pressure reducing lines are detached from the operation signal lines and the signal input lines when the function of front implement control is in an off state. When the function of front implement control is in an off state, the operation signal lines and the signal input lines are directly coupled to each other without the intervention of the pressure reducing lines, so that losses of the hydraulic signals due to the solenoid proportional valves can be avoided. Therefore, while the solenoid proportional valves for front implement control are provided, responsiveness equal to or close to that of the standard machine can be ensured. Hence, the responsiveness of operation of the actuators 31 to 33 in response to operation of the operation lever devices 51 to 53 and the front implement control function can be made compatible with each other. Reductions in the losses of the hydraulic signals can also contribute to an improvement in energy efficiency.

In addition, the selector valves in which the first position A has a return flow passage are used, and the pressure reducing lines are connected to the selector valves such that the pressure reducing lines are on an opposite side of the selector valves from the operation signal lines and the signal input lines. Thus, when front implement control is not performed, the hydraulic signals are short-cut without passing through the pressure reducing lines at all, and are transmitted to the signal input lines. This also contributes to an improvement in responsiveness.

In addition, in the case of the present embodiment, the selector valves 81*b*, 82*a*, 82*b*, 83*a*, and 83*b* are unitized as the selector valve unit 60A, thus facilitating piping work and detachment thereof from the work machine. The same is true for the solenoid proportional valve unit 60B. The unitization also leads to reductions in the line lengths of pipes and the number of pipes, and thus contributes to a further improvement in responsiveness and a reduction in the number of parts. In addition, the whole of the front implement controlling hydraulic unit 60 is not formed as one unit, but is divided into the selector valve unit 60A and the solenoid proportional valve unit 60B. Thus, at a time of occurrence of a defect, only one of the units which includes a valve to be replaced can be replaced, so that good maintainability is achieved. The above-described unitization of the valves also facilitates work of modifying a circuit of the above-described standard machine or a conventional work machine having a front implement control function as in FIG. 3.

In addition, because switching control of the selector valves 81*b*, 82*a*, 82*b*, 83*a*, and 83*b* is performed by turning on and off the switch 7 that turns on and off the front implement control function, the pressure reducing lines can be automatically detached when the front implement control function is turned off. In addition, because the switch 7 is provided to the lever section of an operation lever device, it is possible to perform switching operation of the selector valve 81*b* and the like easily while checking conditions from the cab seat 14 and operating the front work implement 20.

Second Embodiment

The present embodiment is different from the first embodiment in that the selector valves 81*b*, 82*a*, 82*b*, 83*a*, and 83*b* are automatically switched to the first position A in a case where the front work implement 20 is separated from the excavation target surface at a certain distance even when the front implement control function is in an on state. A change is made to a selector valve control section in the present embodiment to realize this control. The selector valve control section according to the present embodiment will next be described.

2-1 Selector Valve Control Section

Figure 7:
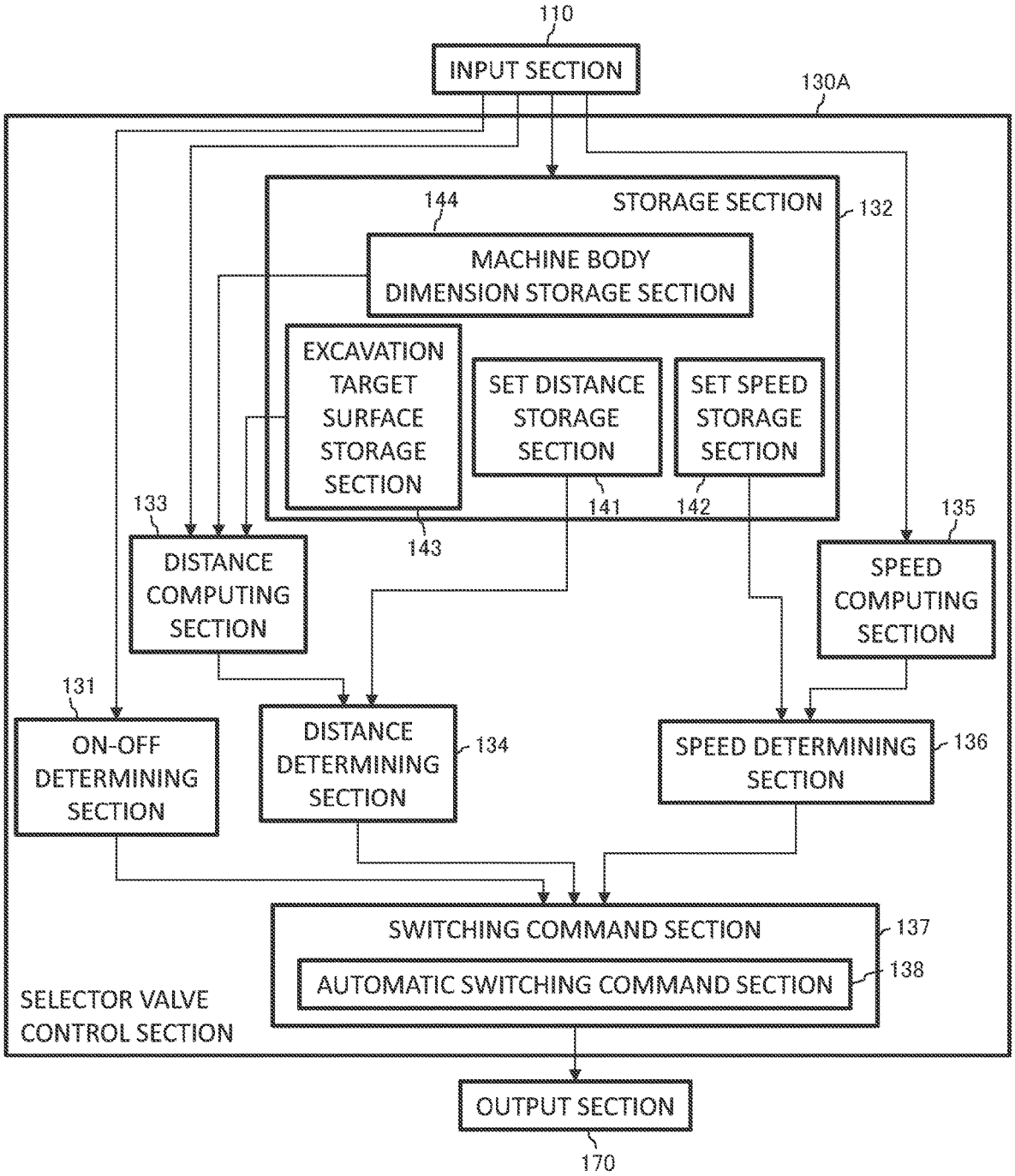
FIG. 7 is a functional block diagram of a selector valve control section provided to a work machine according to a second embodiment of the present invention.

FIG. 7 is a functional block diagram of a selector valve control section included in a work machine according to the second embodiment of the present invention. In FIG. 7, the aforementioned elements are identified by the same reference characters as in the aforementioned drawings, and description thereof will be omitted. A selector valve control section 130A illustrated in FIG. 7 includes a storage section 132, a distance computing section 133, a distance determining section 134, a speed computing section 135, and a speed determining section 136 in addition to the on-off determining section 131 and the switching command section 137. In addition, the switching command section 137 includes an automatic switching command section 138.

Storage Section

The storage section 132 is a functional section that stores various kinds of information. The storage section 132 includes a set distance storage section 141, a set speed storage section 142, an excavation target surface storage section 143, and a machine body dimension storage section 144. The set distance storage section 141 is a storage area storing a set distance D0 (>0) predetermined in advance for a distance D between a specific point P of the front work implement 20 and an excavation target surface S. The set speed storage section 142 is a storage area storing a set speed V0 (>0) predetermined in advance for an operating speed V of a specific actuator (for example, the boom cylinder 31). The excavation target surface storage section 143 is a storage area storing the excavation target surface S. The excavation target surface S is a target ground form to be excavated and formed (shaped) by the hydraulic excavator. The excavation target surface S manually set in a coordinate system having the swing structure 12 as a reference may be stored, or the excavation target surface S may be stored in advance as three-dimensional positional information in a terrestrial coordinate system. The three-dimensional positional information of the excavation target surface S is information obtained by adding positional data to topographic data representing the excavation target surface S by polygons, and is created in advance. The machine body dimension storage section 144 is a storage area storing dimensions of respective sections of the front work implement 20 and the swing structure 12.

Distance Computing Section

The distance computing section 133 is a functional section that computes the distance D between the specific point P of the front work implement 20 and the excavation target surface S on the basis of detection signals of the angle sensors 8*a* to 8*c*, the detection signals being input via the input section 110. An example of the computation of the distance D will be described later.

Distance Determining Section

The distance determining section 134 is a functional section that determines whether or not the distance D between the specific point P and the excavation target surface S, the distance D being computed by the distance computing section 133, is larger than the set distance D0 read from the set distance storage section 141.

Speed Computing Section

The speed computing section 135 is a functional section that computes the operating speed V (extension or contraction speed) of a specific actuator, or the boom cylinder 31 in the present example, on the basis of the signals of the pressure sensors 6*a* and 6*b*, the signals being input via the input section 110. For example, the speed computing section 135 includes a storage section storing a flow rate characteristic (relation between the flow rate of a circulated hydraulic operating oil and an opening degree or the like) of the control valve 41 for the boom cylinder. The opening degree of the control valve 41 is in corresponding relation to the magnitudes of the hydraulic signals to the control valve 41, the magnitudes being detected by the pressure sensors 6*a* and 6*b*. Based on this, the operating speed V of the boom cylinder 31 is computed by the speed computing section 135 on the basis of the flow rate characteristic of the control valve 41 and the signals of the pressure sensors 6*a* and 6*b*. Incidentally, the speed computing section 135 selects the larger of the signals of the pressure sensors 6*a* and 6*b* to be a basis for the computation, and computes the operating speed of the boom cylinder 31. Depending on which signal is set as the basis for the computation, a distinction is made as to whether the computed operating speed V is the extension speed of the boom cylinder 31 or the contraction speed of the boom cylinder 31. Needless to say, the operating speed V computed on the basis of the signal of the pressure sensor 6*b* that detects the pressure signal for a boom lowering command, for example, is the contraction speed of the boom cylinder 31 which contraction speed corresponds to a boom lowering operation. Then, the contracting direction of the boom cylinder 31 is taken as a positive direction of the operating speed V, and the extension speed is treated as a negative speed component.

Speed Determining Section

The speed determining section 136 is a functional section that determines whether or not the operating speed V of the boom cylinder 31, the operating speed being computed by the speed computing section 135, is higher than the set speed V0 read from the set speed storage section 142.

Switching Command Section

The automatic switching command section 138 included in the switching command section 137 according to the present embodiment is a functional section that generates a signal that switches each selector valve to the first position A under certain conditions even when the front implement control function is in an on state. The conditions under which the automatic switching command section 138 generates the signal that switches each selector valve to the first position A are the following three conditions.

(first condition) the signal of the switch 7 is an on signal;

(second condition) a determination signal input from the distance determining section 134 is a signal indicating a result of determination that the distance D between the specific point P and the excavation target surface S is larger than the set distance D0;

(third condition) a determination signal input from the speed determining section 136 is a signal indicating a result of determination that the operating speed V of a specific actuator (the boom cylinder 31 in the present example) is lower than a set speed V1:

When the first condition is satisfied, the switching command section 137 sets the function of the automatic switching command section 138 in an on state, and performs the processing of the automatic switching command section 138. When the second condition and the third condition are then satisfied, the automatic switching command section 138 generates the signal that switches each selector valve to the first position A. In short, together with the processing of the automatic switching command section 138, the switching command section 137 generates the signal that switches each selector valve to the first position A when the first to third conditions are satisfied at the same time and when the function of front implement control is in an off state. Otherwise, a signal that switches each selector valve to the second position B is generated.

As for the other hardware, the work machine according to the present embodiment has a configuration similar to that of the work machine according to the first embodiment.

Figure 8:
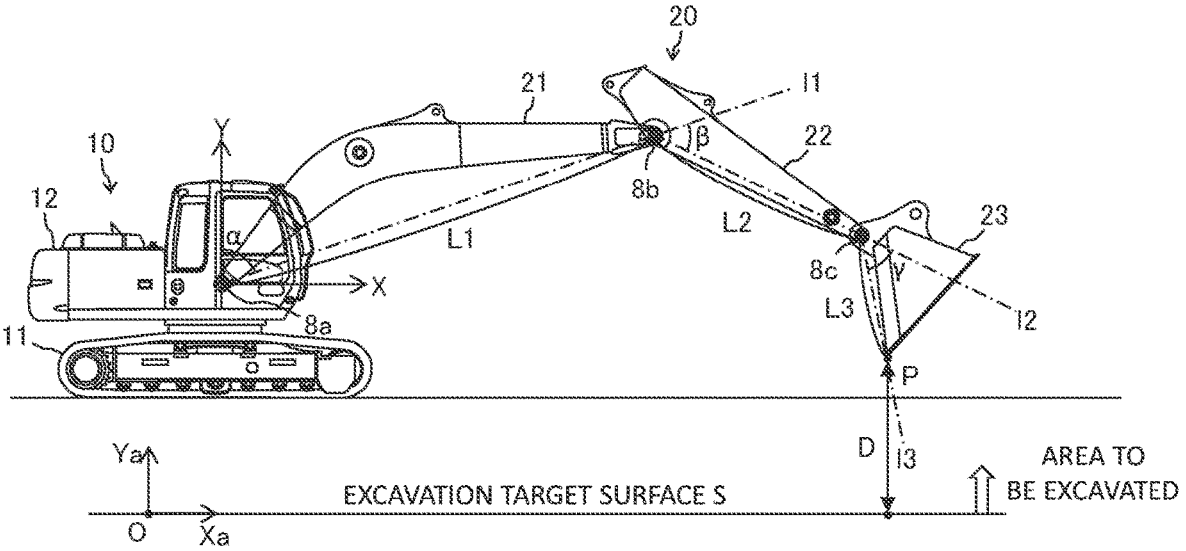
FIG. 8 is a diagram of assistance in explaining a method of computing a distance between a specific point of a front work implement and an excavation target surface by a distance computing section provided to the selector valve control section illustrated in FIG. 7.

2-2 Example of Computation of Distance Between Specific Point and Excavation Target Surface FIG. 8 is a diagram of assistance in explaining a method of computing the distance between the specific point of the front work implement and the excavation target surface by the distance computing section. In FIG. 8, an operating plane of the front work implement 20 (plane orthogonal to a rotation axis of the boom 21 or the like) is viewed from an orthogonal direction (extending direction of the rotation axis of the boom 21 or the like). The actuators 31 to 33 are not illustrated to prevent complexity.

In FIG. 8, the specific point P is set at the position of an end (claw tip) of the bucket 23. While the specific point P is typically set at the end of the bucket 23, the specific point P may be set at another part of the front work implement 20. The distance computing section 133 is supplied with signals from the angle sensors 8*a* to 8*c* via the input section 110, and is supplied with the information of the excavation target surface S from the excavation target surface storage section 143. In addition, when the distance D is computed in the terrestrial coordinate system, the distance computing section 133 is also supplied via the input section 110 with the detection signal of the inclination sensor 8*d*, the positional information of the machine body 10, the positional information being obtained by the positioning devices 9*a* and 9*b*, and the correction information received by the radio set 9*c*. When the distance D is obtained in the terrestrial coordinate system, the distance computing section 133 computes the position and orientation of the machine body 10 by correcting the positional information of the positioning devices 9*a* and 9*b* with the correction information, and computations the inclination of the machine body 10 on the basis of the signal of the inclination sensor 8*d*.

The excavation target surface S is defined by a line of intersection of the operating plane of the front work implement 20 and a target ground form, and positional relation between the excavation target surface S and the machine body 10 is grasped in the terrestrial coordinate system together with information such as the position, orientation, and inclination of the machine body 10. A region on an upper side of the excavation target surface S is defined as an area to be excavated in which the specific point P may be moved. The excavation target surface S is once defined by at least one linear expression in an XY coordinate system having the hydraulic excavator as a reference, for example. The XY coordinate system is an orthogonal coordinate system having the rotation pivot of the boom 21 as an origin, for example. An axis passing through the origin and extending in parallel with the swing central axis of the swing structure 12 is taken as a Y-axis (an upward direction is a positive direction), and an axis orthogonal to the Y-axis at the origin and extending forward is taken as an X-axis (a forward direction is a positive direction). Incidentally, the positional relation between the excavation target surface S and the machine body 10 is known when the excavation target surface S is set manually.

The excavation target surface S defined in the XY coordinate system is defined anew in an XaYa coordinate system as an orthogonal coordinate system of an origin O having the excavation target surface S as one axis (Xa axis). The XaYa coordinate system and the XY coordinate system are in a same plane. Needless to say, a Ya axis is an axis orthogonal to the Xa axis at the origin O. A forward direction of the Xa axis is set as a positive direction, and an upward direction of the Ya axis is set as a positive direction.

The distance computing section 133 calculates the position of the specific point P using dimension data (L1, L2, and L3) of the front work implement 20, the dimension data being read from the machine body dimension storage section 144, and the respective values of rotational angles α, β, and γ detected by the angle sensors 8*a* to 8*c*. The position of the specific point P is obtained as a coordinate value (X, Y) in the XY coordinate system having the hydraulic excavator as a reference, for example. The coordinate value (X, Y) of the specific point P is obtained from Equation (1) and Equation (2) in the following.

$$X=L1\cdot\sin\alpha+L2\cdot\sin(\alpha+\beta)+L3\cdot\sin(\alpha+\beta+\gamma) \quad (1)$$

$$Y=L1\cdot\cos\alpha+L2\cdot\cos(\alpha+\beta)+L3\cdot\cos(\alpha+\beta+\gamma) \quad (2)$$

L1 is a distance between the rotation pivots of the boom 21 and the arm 22, L2 is a distance between the rotation pivots of the arm 22 and the bucket 23, and L3 is a distance between the rotation pivot of the bucket 23 and the specific point P. α is an included angle between the Y-axis (segment extending upward from the origin) and a straight line 11 passing through the rotation pivots of the boom 21 and the arm 22 (segment extending from the origin to the rotation pivot side of the arm 22). β is an included angle between the straight line 11 (segment extending from the rotation pivot of the arm 22 to an opposite side from the origin) and a straight line 12 passing through the rotation pivots of the arm 22 and the bucket 23 (segment extending from the rotation pivot of the arm 22 to the rotation pivot side of the bucket 23). γ is an included angle between the straight line 12 (segment extending from the rotation pivot of the bucket 23 to an opposite side from the rotation pivot of the arm 22) and a straight line 13 passing through the specific point P.

The distance computing section 133 converts the coordinate value (X, Y) of the specific point P defined in the XY coordinate system as described above into the coordinate value (Xa, Ya) in the XaYa coordinate system. The value of Ya of the specific point P thus obtained is the value of the distance D between the specific point P and the excavation target surface S. The distance D is a distance from a point of intersection of a straight line passing through the specific point P and orthogonal to the excavation target surface S and the excavation target surface S to the specific point P, and a distinction is made as to whether the value of Ya is positive or negative (that is, the distance D is a positive value in the area to be excavated, and is a negative value in a region below the excavation target surface S).

2-3 Selector Valve Control

Figure 9:
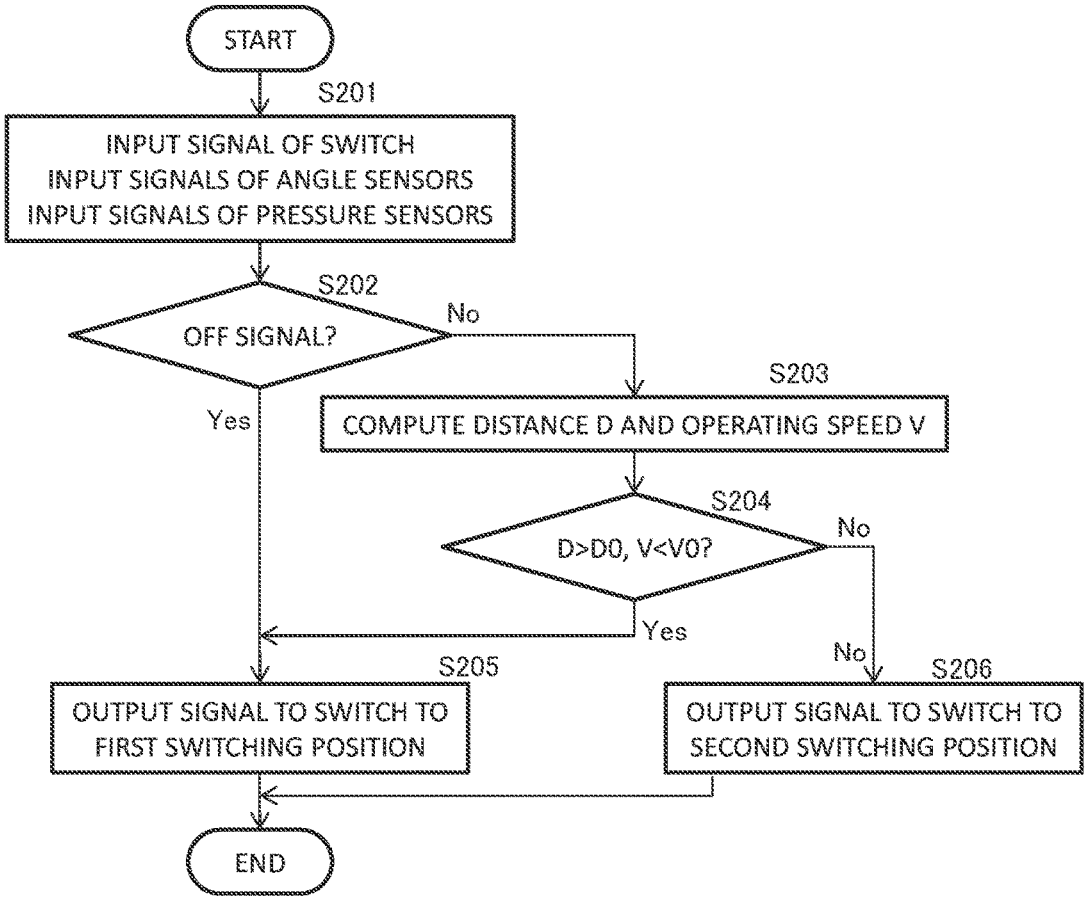
FIG. 9 is a flowchart illustrating a selector valve control procedure of the selector valve control section illustrated in FIG. 7.

FIG. 9 is a flowchart illustrating a selector valve control procedure of the selector valve control section in the present embodiment. During operation, the selector valve control section 130A repeats the procedure of FIG. 9 in predetermined processing cycles (for example 0.1 s).

Step S201

When the selector valve control section 130A starts the procedure of FIG. 9, the selector valve control section 130A is first supplied with respective signals of the switch 7, the angle sensors 8*a* to 8*c*, and the pressure sensors 6*a* and 6*b* via the input section 110 in step S201. In the present example, description will be made supposing that positional relation between the excavation target surface S and the machine body is known information. However, in a case where the positional relation between the machine body and the excavation target surface S is computed in the terrestrial coordinate system as described above, for example, signals of the positioning devices 9*a* and 9*b*, the radio set 9*c*, and the inclination sensor 8*d* are also input together.

Step S202→S205

Next, the selector valve control section 130A determines whether the signal of the switch 7 is an off signal (step S202). In the case of an off signal, the selector valve control section 130A outputs a signal that switches to the first position A by the switching command section 137 (step S205), and thereby switches the selector valves 81*b*, 82*a*, 82*b*, 83*a*, and 83*b* to the first position A. Steps S202 and S205 are a similar procedure to steps S102 and S103 in FIG. 6.

Step S202→S203→S204→S205

When the signal of the switch 7 is an on signal, the selector valve control section 130A shifts the processing to step S203, where the selector valve control section 130A computes the distance D between the excavation target surface S and the specific point P by the distance computing section 133, and computes the operating speed V of the boom cylinder 31 by the speed computing section 135. After shifting the processing to step S204, the selector valve control section 130A determines by the distance determining section 134 whether the distance D is larger than the set distance D0 read from the set distance storage section 141. The set distance D0 is a positive value, and a distinction is made as to whether the distance D is positive or negative, as described above. Thus, whether the specific point P is within the area to be excavated and is separated from the excavation target surface S by more than the set distance D0 is determined here. At the same time, the selector valve control section 130A determines by the speed determining section 136 whether the operating speed V is smaller than the set speed V0 read from the set speed storage section 142. The set speed V0 is a positive value, and a distinction is made as to whether the operating speed V is positive or negative, as described above. Thus, whether or not the boom cylinder 31 is contracting at a speed exceeding the set speed V0 is determined here. When D>D0 and V<V0 as a result of the determination (when the above-described first to third conditions are satisfied in steps S202 and S204), the selector valve control section 130A shifts the processing to step S205, where the selector valve control section 130A outputs a signal that switches each selector valve to the first position A by the automatic switching command section 138.

Step S202→S203→S204→S206

When the procedure of steps S202, S203, and S204 is performed, and the condition that D>D0 and V<V0 is not satisfied, the selector valve control section 130A shifts the processing from step S204 to step S206. After shifting the processing to step S206, the selector valve control section 130A outputs a command signal by the automatic switching command section 138, and thereby switches the selector valves 81*b*, 82*a*, 82*b*, 83*a*, and 83*b* to the second position B. Step S206 is a procedure corresponding to step S104 in FIG. 6.

Incidentally, in the present embodiment, the set distance D0 is set to coincide with a threshold value for determining whether to perform control of the solenoid proportional valve 61*b* and the like by the front implement control section 120. That is, when the distance D is equal to or less than the set distance D0, the shut-off valve 70 is opened at the same time as the selector valve 81*b* and the like are switched to the second position B, and the solenoid proportional valve 61*b* and the like are energized by the front implement control section 120 according to the distance D or the like (opening degree is changed). Conversely, when the distance D exceeds the set distance D0, the shut-off valve 70 is closed at the same time as the selector valve 81*b* and the like are switched to the first position A, and also the solenoid proportional valve 61*b* and the like are demagnetized.

2-4 Effect

The present embodiment also provides similar effects to those of the first embodiment. In addition, when the specific point P is separated from the excavation target surface S by a distance exceeding the set distance D0 and the boom cylinder 31 is not contracting at a speed exceeding the set speed V0, the selector valves 81*b*, 82*a*, 82*b*, 83*a*, and 83*b* are switched to the first position A even when the function of front implement control is in an on state. That is, when the bucket 23 is distant from the excavation target surface S, and there is no fear of the bucket 23 immediately entering the outside of the area to be excavated in consideration of operating conditions of the front work implement 20, priority is automatically given to responsiveness even when the function of front implement control is in an on state. A further improvement in work efficiency can be thereby expected.

(Modifications)

Figure 10:
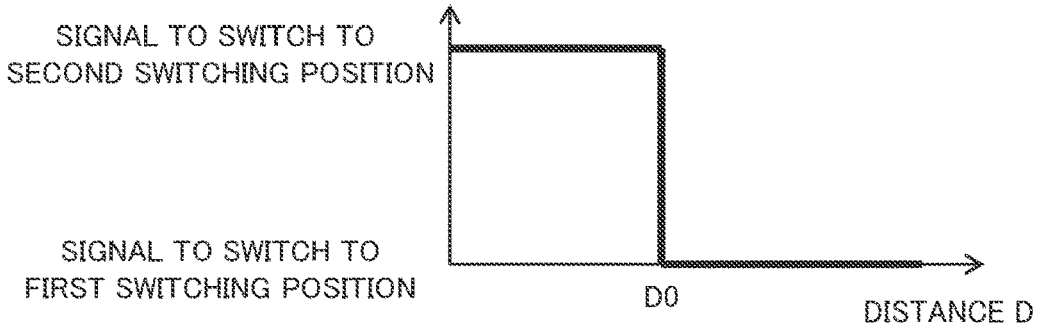
FIG. 10 is a diagram of assistance in explaining selector valve control by another example of the selector valve control section provided to the work machine according to the second embodiment of the present invention.

In the second embodiment, a configuration is illustrated in which the first to third conditions are satisfied in step S204 when D>D0 and V<V0, and the selector valve 81*b* and the like are switched to the first position A even when the function of front implement control is in an on state. However, the above-described third condition related to the operating speed V may be omitted. That is, when the function of front implement control is in an on state and the distance D exceeds the set distance D0 (when the first condition and the second condition are satisfied), the selector valve 81*b* and the like may be configured to be switched to the first position A irrespective of the operating speed V, as illustrated in FIG. 10. FIG. 10 illustrates relation between the command signal to the selector valve 81*b* and the like and the distance D. In the example of FIG. 10, each selector valve is switched to the first position A irrespective of the operating speed V when the distance D exceeds the set distance D0, and each selector valve is switched to the second position B irrespective of the operating speed V when the distance D is equal to or less than the set distance D0. Also in this case, work efficiency can be improved under conditions where the specific point P is separated from the excavation target surface S and there is a small possibility of the bucket 23 deviating to the outside of the area to be excavated. There is also an advantage of being able to simplify control. In addition, the set speed storage section 142, the speed computing section 135, and the speed determining section 136 can be omitted.

In addition, in the second embodiment, description has been made by taking as an example a case where the extension or contraction speed of the boom cylinder 31 is computed as the operating speed V of the actuator. However, the extension or contraction speeds of the arm cylinder 32 and the bucket cylinder 33 may be taken into consideration as the operating speed V in determination for the switching of the selector valve 81*b* and the like. Alternatively, a plurality of the actuators 31 to 33 may be selected, and the operating speed V of the plurality may be taken into consideration. In addition, it is possible to compute moving speed of the specific point P from the operating speed V of one or a plurality of actuators, extract a component perpendicular to the excavation target surface S, and compute approaching speed of the specific point P toward the excavation target surface S in the area to be excavated. Rather than simply considering the operating speed V of the actuator, the operating speed V may be converted into the approaching speed of the specific point P toward the excavation target surface S, and the approaching speed may be used as a basis for determination.

Incidentally, the functional sections corresponding to the distance computing section 133 and the speed computing section 135 can be included also in the front implement control section 120. In that case, the distance D and the operating speed V computed in the front implement control section 120 may be input to the distance determining section 134 and the speed determining section 136 of the selector valve control section 130A.

Figure 11:
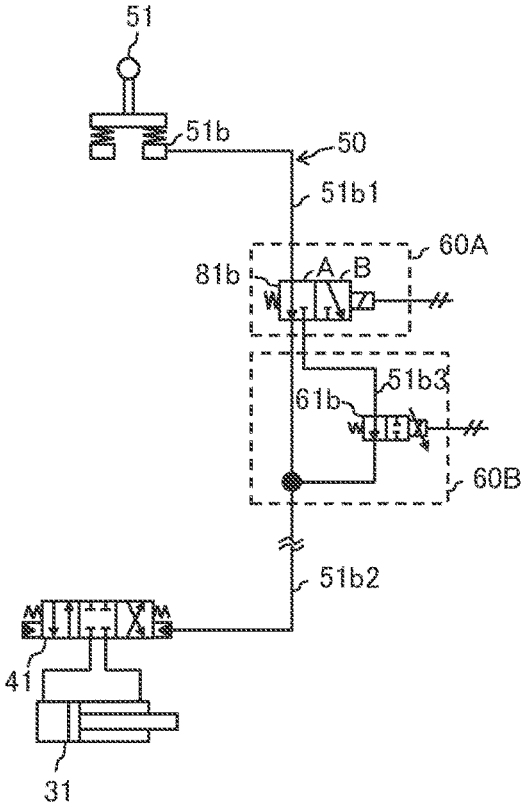
FIG. 11 is a hydraulic circuit diagram obtained by extracting principal parts of a front implement controlling hydraulic unit provided to a work machine according to a modification.

In addition, the selector valves, the pressure reducing lines, and the solenoid proportional valves can also be connected as in FIG. 11. FIG. 11 is obtained by extracting only the signal line for boom lowering operation. Relation between reference characters and elements in the figure corresponds to that of FIG. 3. Also in the configuration of FIG. 11, the hydraulic signal can be made not to pass through the solenoid proportional valve 61*b* when the front implement control function is off. However, in the circuit configuration of the figure, the pressure reducing line 51*b*3 merges with the signal input line 51*b*2, and a loss of the hydraulic signal at a merging point of the pressure reducing line 51*b*3 may occur when the front implement control function is off. In that respect, the circuit configuration according to the first embodiment (FIG. 3) without such a merging point is more advantageous in terms of responsiveness. In addition, in the circuit configuration of FIG. 11, the hydraulic signal passes through the solenoid proportional valve unit 60B even when front implement control is off. On the other hand, the circuit configuration (FIG. 3) according to the first embodiment is advantageous in terms of responsiveness in that the signal path is short-cut without passing through the solenoid proportional valve unit 60B.

In addition, the selector valves 81*b*, 82*a*, 82*b*, 83*a*, and 83*b* may be divided into a plurality of groups, and the set distance D0 may be set at respective different values. In addition, not all of the selector valves 81*b*, 82*a*, 82*b*, 83*a*, and 83*b* are necessarily needed. It suffices to select and implement at least one necessary selector valve of these selector valves. In addition, in the described example, a solenoid proportional valve and a selector valve are not connected to the operation signal line 51*a*1 for a boom raising command. However, when necessary, a pressure reducing line and a solenoid proportional valve can be connected also to the operation signal line 51*a*1 via a selector valve.

In addition, the selector valves 81*b*, 82*a*, 82*b*, 83*a*, and 83*b* may be hydraulically operated selector valves rather than solenoid valves. For example, when the selector valve 81*b* and the like are hydraulically operated selector valves, a circuit is established by guiding the pump line 37*a* to hydraulic driving sections of the selector valves 81*b*, 82*a*, 82*b*, 83*a*, and 83*b* via the switch 7, and configuring the pump line 37*a* to be opened and closed by the switch 7.

A case has been illustrated in which the solenoid proportional valves 61*b*, 62*a*, 62*b*, 63*a*, and 63*b* for pressure reduction are of a normally open type, and the solenoid proportional valves 71*a*, 73*a*, and 73*b* for pressure increase and the shut-off valve 70 are of a normally closed type. Even when the application of the normally open type and the normally closed type is reversed, a circuit is established by reversing timing of energization and demagnetization.

In addition, a case has been illustrated and described in which the solenoid proportional valves 61*b*, 62*a*, 62*b*, 63*a*, and 63*b* for pressure reduction and the solenoid proportional valves 71*a*, 73*a*, and 73*b* for pressure increase are provided for front implement control. However, not all of these valves are necessarily needed. One kind of front implement control can be performed when there is at least one of these valves (for example the solenoid proportional valve 61*b* and the pressure reducing line 51*b*3 that reduce the pressure of the hydraulic signal for a boom lowering command). The present invention can be applied to work machines using at least one of the solenoid proportional valves that reduce the pressure of the hydraulic signals of the operation lever devices 51 to 54.

In addition, while description has been made by taking as an example a case where the operating speed V of the actuator is computed on the basis of the magnitude of a pressure signal, the operating speed V of the actuator can also be obtained on the basis of rates of change in signals of the angle sensors 8*a* to 8*c*, for example. For example, the extension or contraction speed of the boom cylinder 31 can be obtained on the basis of a rate of change in the signal of the angle sensor 8*a*. The operating speed V of the actuator can be obtained by using stroke sensors that detect stroke amounts of the actuators 31 to 33 and inclination angle sensors that detect the inclination angles of the boom 21, the arm 22, and the bucket 23.

In addition, while description has been made by taking as an example a typical hydraulic excavator that uses an engine as the prime mover 17 and drives the hydraulic pump 36 and the like by the engine, the present invention is applicable also to a hybrid hydraulic excavator that drives the hydraulic pump 36 and the like with an engine and a motor as a prime mover. In addition, the present invention is applicable also to an electric hydraulic excavator or the like that drives the hydraulic pump with a motor as a prime mover.

DESCRIPTION OF REFERENCE CHARACTERS

6*a*, 6*b*: Pressure sensor
7: Switch
8*a* to 8*c*: Angle sensor (Posture sensor)
10: Machine body
20: Front work implement
31: Boom cylinder (Actuator)
32: Arm cylinder (Actuator)
33: Bucket cylinder (Actuator)
36: Hydraulic pump
37: Pilot pump
41 to 44: Control valve
51 to 54: Operation lever device
51*a*1, 51*b*1, 52*a*1, 52*b*1, 53*a*1, 53*b*1, 54*a*1, 54*b*1: Operation signal line
51*a*2, 51*b*2, 52*a*2, 52*b*2, 53*a*2, 53*b*2, 54*a*2, 54*b*2: Signal input line
51*b*3, 52*a*3, 52*b*3, 53*a*3, 53*b*3: Pressure reducing line
61*b*, 62*a*, 62*b*, 63*a*, 63*b*: Solenoid proportional valve
81*b*, 82*a*, 82*b*, 83*a*, 83*b*: Selector valve
100: Controller unit
110: Input section
120: Front implement control section
130, 130A: Selector valve control section
131: On-off determining section
133: Distance computing section
134: Distance determining section
135: Speed computing section
136: Speed determining section
137: Switching command section
138: Automatic switching command section
141: Set distance storage section
142: Set speed storage section
D: Distance between a specific point and an excavation target surface
D0: Set distance
170: Output section
P: Specific point
S: Excavation target surface
V: Operating speed of an actuator
V0: Set speed

The invention claimed is:

1. A work machine comprising:
a machine body;
a front work implement provided to the machine body;
an actuator configured to drive the front work implement;
a posture sensor configured to detect a posture of the front work implement;
a hydraulic pump configured to deliver a hydraulic operating oil that drives the actuator;
a control valve configured to control a flow of the hydraulic operating oil supplied from the hydraulic pump to the actuator;
an operation lever device configured to generate hydraulic signals to be output to the control valve according to operations;
a pilot pump configured to supply a hydraulic operating oil to the operation lever device;
a pilot line configured to connect the operation lever device to the control valve;
a solenoid proportional valve provided to the pilot line, the solenoid proportional valve reducing a pressure of one of the hydraulic signals generated by the operation lever device; and
a front implement control section configured to limit operation of the front work implement by controlling the solenoid proportional valve on a basis of a detection signal of the posture sensor, wherein
the pilot line is equipped with a selector valve configured to switch paths of the hydraulic signal,
the pilot line includes an operation signal line connecting a signal output valve of the operation lever device to the selector valve, a signal input line connecting the selector valve to a hydraulic driving section of the control valve, and a pressure reducing line having two ends which are both connected to the selector valve,
the solenoid proportional valve is provided in the pressure reducing line to reduce the pressure of the hydraulic signal flowing through the pressure reducing line, and
the selector valve is configured to be switchable between a first position and a second position, wherein the first position interrupts connection of the operation signal line and the pressure reducing line and connects the operation signal line to the signal input line, and wherein the second position connects the operation signal line to the signal input line via the pressure reducing line.

2. The work machine according to claim 1, further comprising:
a selector valve unit including the selector valve; and
a solenoid proportional valve unit including the solenoid proportional valve.

3. The work machine according to claim 1, wherein the operation signal line and the signal input line are connected to one side of the selector valve, and the pressure reducing line is connected to another side of the selector valve.

4. The work machine according to claim 2, further comprising:

a switch configured to output a signal that turns on or off control of the front implement control section; and a controller unit configured to control the selector valve unit and the solenoid proportional valve unit;

the controller unit including an input section configured to input the signal from the switch, a selector valve control section configured to control the selector valve, and an output section configured to output a command signal generated by the selector valve control section to the selector valve, and the selector valve control section including an on-off determining section configured to determine whether the signal input from the switch via the input section is an on signal that sets the control of the front implement control section in an on state or an off signal that sets the control of the front implement control section in an off state, and a switching command section configured to generate a command signal that switches the selector valve to the first position when the on-off determining section determines that the signal input from the switch is the off signal, and generate a command signal that switches the selector valve to the second position when the on-off determining section determines that the signal input from the switch is the on signal.

5. The work machine according to claim 4, wherein the selector valve control section includes a distance computing section configured to compute a distance between a specific point of the front work implement and an excavation target surface on a basis of the detection signal of the posture sensor, the detection signal being input via the input section, a storage section having a set distance storage section storing a set distance determined in advance for the distance between the specific point and the excavation target surface, and a distance determining section configured to determine whether or not the distance between the specific point and the excavation target surface, the distance being computed by the distance computing section, is larger than the set distance, and the switching command section includes an automatic switching command section configured to generate the command signal that switches the selector valve to the first position irrespective of whether the signal from the switch is the on signal or the off signal when the distance determining section determines that the distance between the specific point and the excavation target surface is larger than the set distance.

6. The work machine according to claim 5, wherein the storage section includes a set speed storage section storing a set speed determined in advance for an operating speed of a specific actuator, the selector valve control section includes a speed computing section configured to compute the operating speed of the specific actuator on a basis of pressure of the hydraulic signals of the operation lever devices or the detection signal of the posture sensor, and a speed determining section configured to determine whether or not the operating speed of the specific actuator, the operating speed being computed by the speed computing section, is higher than the set speed, and the automatic switching command section generates the command signal that switches the selector valve to the first position irrespective of whether the signal from the switch is the on signal or the off signal when the distance determining section determines that the distance between the specific point and the excavation target surface is larger than the set distance and the speed determining section determines that the operating speed of the specific actuator is lower than the set speed.

* * * * *